United States Patent [19]

Sugiyama

[11] 4,417,217

[45] Nov. 22, 1983

[54] DISCHARGING ELEMENT ENERGIZING CIRCUIT FOR DISCHARGE-TYPE FIRE ALARM SENSOR UNIT

[75] Inventor: Kazuo Sugiyama, Mitaka, Japan

[73] Assignee: Shigeo Matsuda, Tokyo, Japan

[21] Appl. No.: 244,890

[22] Filed: Mar. 18, 1981

[30] Foreign Application Priority Data

Mar. 24, 1980 [JP] Japan ..... 55-037279

[51] Int. Cl.[3] ..... G08B 17/10

[52] U.S. Cl. ..... 331/66; 250/387; 315/150; 315/274; 340/600; 331/112

[58] Field of Search ..... 331/65, 66, 112, 177 R; 340/600, 632, 634, 628, 629; 250/372, 387; 356/51; 315/149, 150, 246, 268, 274, 276

[56] References Cited

U.S. PATENT DOCUMENTS 3,742,475 6/1973 Liebermann et al. ..... 340/632

4,287,516 9/1981 Coleman ..... 340/629

FOREIGN PATENT DOCUMENTS 1560731 2/1980 United Kingdom ..... 340/600

*Primary Examiner*—Siegfried H. Grimm

[57] ABSTRACT

A discharging element energizing circuit for a discharge-type fire alarm sensor unit including a discharging element, wherein a power supply circuit gives a power voltage to the discharging element in the form of periodical output pulses making same ready to discharge and a feedback circuit is provided to supply a feedback signal obtained from the discharging element to the power supply circuit so as to vary the interval of the output pulses. The sensor unit is continuously sensitive to ultraviolet rays only caused by a fire disaster, thus preventing a malfunctional alarm. Power consumption is reduced considerably, allowing the unit to be operated with commercially available dry cells.

3 Claims, 2 Drawing Figures

DISCHARGING ELEMENT ENERGIZING CIRCUIT FOR DISCHARGE-TYPE FIRE ALARM SENSOR UNIT

FIELD OF THE INVENTION

The present invention relates to a discharging element energizing circuit for use in a discharge-type fire alarm sensor unit.

BACKGROUND OF THE INVENTION

Fire alarm sensor units which transmit alarm signals by sensing ultraviolet rays emitted from blazes have been known. Such a type of sensor unit is provided with a discharging element such as a discharge tube for sensing the emission of ultraviolet rays and for activating an alarm system using the discharge current.

In order to keep the discharge tube in its active state ready to discharge, a high voltage of 300 volts or more must be kept applied to the tube, and it is practically difficult to use commercially available dry cells for the power source of the sensor unit.

The fire alarm sensor unit of this type is inherently desired to operate with high sensitivity while consuming less power. Less power consumption will permit a compact design of the whole unit as well as the use of commercially available dry cells. On the other hand, a high-sensitive operation will require a circuit arrangement for generating a high voltage as mentioned above.

Moreover, a sensor circuit arranged to operate with high sensitivity is likely to become unstable because of its possible detection of rays other than those from blazes such as spontaneous radioactive rays. Such malfunction is undesirable for this kind of system which is required to have high-reliability in operation to prevent the occurrence of a malfunctional alarm.

In view of the foregoing technical problems, the present invention is contemplated to solve the problems effectively. The present invention is based on the fact that spontaneous radioactivity and the like causing malfunctional alarms occur intermittently whereas ultraviolet rays are emitted continuously from blazes caused by a fire disaster.

OBJECT OF THE INVENTION

An object of the present invention is to provide a discharging element energizing circuit for use in a dischargetype fire alarm sensor unit including a discharging element and a power supply circuit for supplying the discharging power voltage in the form of periodical pulses to the discharging element, characterized in that the energizing circuit is further provided with a feedback circuit whereby the output of the discharging element is fed back to the power supply circuit so as to vary the interval of the power pulses.

According to the present invention, the sensor unit is continuously sensitive to ultraviolet rays only caused by a fire disaster because of the fact that the frequency of discharge caused by a fire is different from those due to spontaneous radioactive rays, thus preventing a malfunctional alarm. Furthermore, power consumption is reduced considerably since the power voltage is supplied in the form of periodical pulses, thus advantageously allowing the operation by use of commercially available dry cells.

Other objects and advantages of the present invention will be apparent from the following detailed description of a preferred embodiment thereof and from the attached drawings.

DETAILED DESCRIPTION OF THE INVENTION

Figure 1:
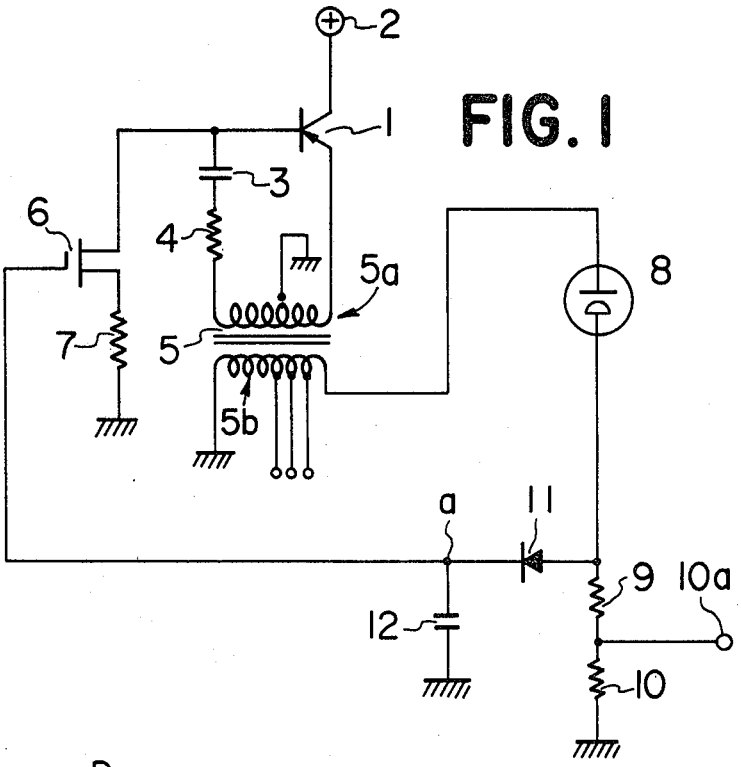
FIG. 1 is a circuit diagram showing a preferred embodiment of the present invention.

In FIG. 1, the collector of an oscillator transistor 1 is connected to a power source 2. A capacitor 3, a resistor 4 and a primary winding 5*a* of a transformer 5 are connected in series between the base and emitter of the transistor 1 to form a close loop, so that the combination of the transistor 1, capacitor 3, resistor 4 and transformer 5 constitutes a blocking oscillator. The base of the transistor 1 is further connected to the drain of a field effect transistor 6 having its source electrode grounded through a resistor 7. One end of a secondary winding 5*b* of the transformer 5 is grounded and the other end thereof is connected to the anode of a discharge tube 8 serving as a discharging element, and the cathode of the discharge tube 8 is grounded through a serial connection of resistors 9 and 10. The cathode of the discharge tube 8 is further connected to the anode of a diode 11 having its cathode connected to the gate of the transistor 6 and also to the ground through a capacitor 12. A feedback circuit is thus completed. An output terminal 10*a* is provided on a junction point between the resistors 9 and 10, so that the output signal is supplied to an alarm circuit (not shown in the figure).

Function of the discharge tube energizing circuit in accordance with the present invention will be described below.

The blocking oscillator as described above normally generates pulses having a predetermined interval and a pulse voltage stepped up through the transformer 5. Then the pulse voltage is supplied to the discharge tube 8, thus keeping this ready to discharge. The oscillation interval of the oscillator can be changed by varying the base current of the oscillator transistor 1. In this circuit arrangement, upon frequent occurrence of discharge at the tube 8, the capacitor 12 in the feedback circuit is charged, resulting in an increased voltage at a point a. When this voltage exceeds a certain threshold level, the transistor 6 operates to increase the base current of the transistor 1 and the oscillation interval becomes short. Conversely, when the discharge occurs intermittently the voltage at the point a does not reach the threshold level. Thus, the transistor 6 does not affect the base current of the transistor 1, and the oscillator does not vary the oscillation interval. The discharging of the discharge tube 8 produces an alternating-current signal at the output terminal 10*a*.

Ultraviolet rays and radioactive rays are sensed during periods when the power, i.e. the high voltage pulse, is supplied to the discharge tube 8. In order to minimize the power consumption, it is desirable to elongate the oscillation interval. However, a too long oscillation interval deteriorates the sensing capability. Preferably, the oscillation interval is about 1 second for a pulse duration of about 1 millisecond.

In this arrangement, narrow voltage pulses are applied to the discharge tube 8 at a frequency of about 60 pulses per minute, whereas spontaneous radioactive rays enter the discharge tube at a rate of 20 to 30 times per minute. Thus, the chance of simultaneous occurrence of a spontaneous radiation and a voltage pulse is very small, resulting in a rare discharging of the discharge tube 8 caused by spontaneous radiations. Although the discharge current charges the capacitor 12 through the diode 11, the voltage at the point a does not reach the threshold level, as mentioned previously. Thus, the interval of oscillation pulses does not vary, and the blocking oscillator keeps the predetermined oscillating condition. In this case, the discharge finishes momentarily.

On the other hand, ultraviolet rays emitted from blazes of a fire disaster enter the discharge tube 8 frequently and consecutively, and the discharge tube 8 operates to discharge with a very high frequency. In the earier stage of operation, the discharge repeats frequently due to the detection of ultraviolet rays, and the capacitor 12 is charged cumulatively. Consequently, the voltage at the point a is built up to increase the base current of the oscillator transistor 1 through the transistor 6, so that the oscillation interval becomes short. The higher oscillation frequency further increases the chance of sensing ultraviolet rays and thus the number of discharges. This operation is repeated and the chance of sensing ultraviolet rays is further more increased.

As described above, the ultraviolet rays emitted from blazes of a fire disaster are sensed at an increasing frequency compared to the case of sensing spontaneous radioactive rays, and the oscillation frequency varies depending on the rate of detection. As the result, an alternating-current signal due to the repetitive discharge caused by the fire disaster only is output through the output terminal 10*a* so as to activate an alarm circuit in the following stage. A malfunctional alarm caused by spontaneous radioactivity is thus prevented.

Figure 2:
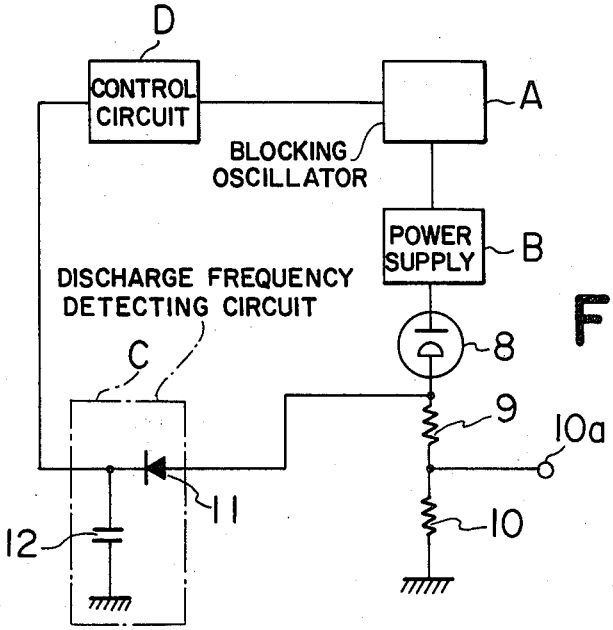
FIG. 2 is a block diagram of the embodiment shown in FIG. 1.

FIG. 2 is a block diagram of an energizing circuit for the discharge tube 8 as described above, in which denoted at a block A is a switching circuit such as a blocking oscillator for generating pulses periodically, at a block B is a power supply means such as a voltage step-up transformer for supplying a discharge voltage to the discharge tube 8, at a block C is a discharge frequency detecting circuit such as that made up of the diode 11 and capacitor 12 as mentioned above, and at a block D is a control circuit such as that consisting of a field effect transistor as mentioned above for varying the oscillation frequency of the switching circuit A depending on the voltage across the capacitor 12.

The discharging element energizing circuit in accordance with the present invention is basically constructed of the circuit components shown in FIG. 2. The circuit arrangement may be modified based on this fundamental circuit.

Owing to the intermittent power voltage produced by pulse oscillation and stepped up by the transformer so as to be applied to the discharge tube 8, the power consumption is made small, allowing the use of commercially available dry cells for the power source.

It can be seen from the above description of the present invention that a power in the form of periodical pulses is supplied to a discharging element for sensing ultraviolet rays emitted from blazes, with the frequency of the power voltage being proportional to the frequency of discharging so as to increase the number of discharges, whereby only ultraviolet rays caused by a fire disaster are sensed reliably for purposes of alarm so that malfunctional alarms due to spontaneous radioactivity can be prevented. Furthermore, power consumption can be reduced considerably owing to the power supply in the form of periodical pulses, and commercially available dry cells can be used for the power source since the source voltage is stepped up by the transformer.

What is claimed is:

1. A circuit for energizing a current discharge element of a discharge-type fire alarm sensor unit including a discharging element, comprising: a first circuit supplying a power voltage to said discharging element in the form of periodical output pulses making said discharging element ready to discharge a current; a second circuit supplying a feedback signal obtained from said discharging element to said first circuit so as to vary the interval of said output pulses, said first circuit comprising a third circuit generating reference pulses, a fourth circuit stepping up the voltage of said reference pulses to produce said output pulses, and a fifth circuit varying the interval of said reference pulses depending on said feedback signal supplied from said second circuit.

2. A discharging element energizing circuit according to claim 1, wherein: said second circuit is an integration circuit comprising a diode and a capacitor; said third circuit is a blocking oscillator comprising a transistor and an R-L-C resonance circuit; and said fifth circuit is a signal transforming circuit comprising a field effect transistor transforming a voltage input into a current output.

3. A discharging element energizing circuit according to claim 2, wherein: said resonance circuit is connected between a base electrode and an emitter electrode of said transistor, said base electrode being further connected to a drain electrode of said field effect transistor.

* * * * *